364-422 SR
XR 3,982,432

United St
Hammond

[11] 3,982,432
[45] Sept. 28, 1976

[54] WELL MONITORING AND ANALYZING SYSTEM

[76] Inventor: William D. Hammond, Reforma 76-504, Mexico City, Mexico

[22] Filed: Jan. 15, 1975

[21] Appl. No.: 541,199

[52] U.S. Cl. ..... 73/151.5; 73/155
[51] Int. Cl.[2] ..... E21B 47/00
[58] Field of Search ..... 73/155, 152, 153, 151.5; 175/48

[56] References Cited

UNITED STATES PATENTS

| | | | |
|---|---|---|---|
| 2,806,372 | 9/1957 | Arps | 73/151.5 |
| 3,462,761 | 8/1969 | Horeth et al. | 73/152 UX |
| 3,512,164 | 5/1970 | Bynum | 73/153 X |
| 3,750,766 | 8/1973 | Thompson et al. | 73/153 X |

*Primary Examiner*—Jerry W. Myracle
*Attorney, Agent, or Firm*—Torres & Berryhill

[57] ABSTRACT

Described is a system for automatically recording information about the physical condition, content and location of earth formations penetrated during drilling of a well, the rate of drilling the well, the well depth, the condition and content of the drilling fluids, and procedures followed in the drilling operation. Immediate visual displays are provided which permit comparisons between graphically recorded input and output data representing, respectively, the condition and content of an identified sample of drilling fluid as it enters the formation from the drill bit and the same fluid sample after it has returned to the well surface. To this end, the volume, or "lag", of fluid required to pump a sample of fluid from the drill bit to the well surface is determined and means are provided to automatically determine the amount of fluid injected into the well between each incremental unit of advance of the drill bit. The input data is graphically recorded on a first strip chart which advances at the rate of advance of the drill bit while the output data is graphically recorded on a second strip chart which advances, after the lag, as a function of the volume of the returning drill fluid. The display of the information on the first chart is delayed relative to the second chart in an amount sufficient to graphically align the output and input data representing the same identified sample of drill fluid.

25 Claims, 1 Drawing Figure

WELL MONITORING AND ANALYZING SYSTEM

BACKGROUND OF THE INVENTION

The present invention relates to a system and related means for monitoring well drilling procedures, drilling rate and depth and for analyzing the condition and content of the earthen formations being penetrated by the well.

Conventionally, the length of the well is determined by measuring the length of drill string extending into the well bore and information regarding the formation condition and content is obtained by analyzing the drilling fluid ("mud") and formation bit cuttings which are returned to the surface from the bottom of the well bore. To this end, the cuttings are analyzed and measurements are made of the amount and type of gas contained in the returning mud, the temperature of the returning mud, the returning mud density, resistivity and various other mud parameters. The information obtained from these measurements is useful in determining that an oil or gas bearing formation has been penetrated and in determining the location and the quantity and quality of the petroleum effluents contained within the formation. The information may also be useful in determining preferred conditions, such as drill bit weight, mud weight and rate of bit revolution required for optimum formation of the well bore.

While equipment and techniques for analyzing the mud and the entrained bit cuttings are conventional there are problems in determining at which subsurface location in the well bore a selected sample of returning well fluid was emitted from the drill bit or a selected bit cutting was drilled away from the formation. In solving these problems, it is customary to calculate the volume of drilling fluid required to displace the cuttings and drilling fluid in the well bore from the bottom of the well bore to the well surface. These calculations employ information regarding the volume of the well bore, the volume of the drilling equipment within the bore and the volume of fluid injected into the well through the drill string. This latter figure is a function of the pump chamber volume and the number of pump strokes occurring in the pumping system used to inject the drilling fluids into the well. Thus, the volume of each pump stroke, the rate and number of pump strokes, the volume of the bore hole, the interior volume of the drill string and the volume occupied by the drill pipe and bit in the hole are employed for calculating the specific subsurface location from which a cutting was drilled and at which a sample of returning fluid taken at the well surface was ejected from the drill bit.

Conventionally, the number of pump strokes required to pump the well fluid and entrained cuttings from the bit location to the well surface is calculated and a pump stroke counter is employed to count the pump strokes. An operator monitors the counter to determine when the calculated number is reached. This calculated number, representative of volume, is referred to as the lag. In practice, the pump stroke counter is initially set to zero with the bit at a known depth point of X feet. When 1 foot (or other desired interval) has been drilled, the bit is at a second lower depth point of X+1 feet and the pump stroke counter reading, for example 100, is noted by the operator and manually recorded. After the lag count is reached, the operator manually removes samples of the returning drilling fluid and cuttings appearing at the well surface during the next 100 pump strokes. Accordingly, these cutting samples are cuttings taken from the bore between the points at X and (X+1) feet and the fluid samples are from the fluid ejected from the drill bit during the time the bit traveled between these same two points.

It will be appreciated that the described conventional procedure requires that an operator know the pump stroke count when the bit is at the beginning of the drilling interval where the sample is to be taken, that an accurate calculation be made to determine the lag, that the samples be taken after the lag has expired and before the fluid and cuttings from a lower interval are returned to the surface and that the samples be properly marked with their interval origin. Because of the need for human intervention, this procedure is often difficult to implement and errors and omissions occur frequently.

In conventional well analyzing and monitoring systems, it is also difficult to appreciate the significance of information obtained from the various recording and monitoring apparatuses employed at the well site. The difficulty stems, in part, from the need to correlate the output data obtained from the monitoring equipment with the bit location and to compare the changes occurring between the drilling fluid being injected into the well and that circulated to the surface. Such correlations and comparisons are made even more difficult by the fact that conventional strip charts are driven at a constant rate while the drilling rate is variable. As a result, the quantity of information appearing within a given increment of chart advance changes with changes in the drilling rate. Since the monitored parameters, such as gas content, mud resistivity, mud temperature, mud density and others must be compensated for lag and drilling rate variations before output data for an identified sample may be correlated with the bit depth at the time the sample was ejected from the drill string and also before the input and output data for such sample may be compared with each other, on-site comparisons and analysis usually are time consuming and require the use of experienced personnel.

SUMMARY OF THE INVENTION

The system of the present invention provides a means for automatically signalling that an identified sample of drilling fluid and/or cuttings has been circulated to the well surface from a known subsurface location. Means are included in the system for measuring various parameters relating to the condition and content of drilling fluid, first as it is being pumped into the drill string and then again after it has circulated to the well surface from the bottom of the well. The well depth and the measured parameters are automatically recorded and graphically aligned so that the data representative of the fluid injected into the well bore from the drill bit may be directly compared with the data taken from the same fluid after it has been circulated to the well surface. A display correlating bit depth with parameter values is also automatically formed. By this means, immediate visual comparisons and analysis may be made so that information regarding the well condition and content at various subsurface locations may be rapidly obtained and evaluated.

The system of the present invention, in addition to providing graphically recorded information, compensated for lag, also causes either a signal or an automatic sampling, or both, to occur when fluid and/or cuttings from a selected subsurface interval have been circulated to the well surface.

Accordingly, it is an object of the present invention to provide an automatic system for recording well depth, compensating for lag, and correlating input and output data taken from drilling fluid used in drilling a well.

It is another object of the present invention to provide a system for recording output parameter values on a recording medium which is driven at a constant rate and automatically correlating the parameter values taken from a given sample of well fluid or cuttings with the drill bit depth at the time such sample was ejected from the drill string into the bore or the cuttings were removed from the formation.

Another object of the present invention is to provide an automatic signalling and/or sampling means in a system for graphically recording, lag compensating and graphically aligning data taken from drilling fluids injected into a well and returned to the well surface.

It is a further object of the present invention to provide, in a system of the type described, automatic means for removing, at the well surface, samples of drilling fluids and/or bit cuttings from fluid which was ejected from the drill bit in the bore interval between two given subsurface locations when the ejected fluid has been circulated from such interval to the well surface and to identify such samples with the bore interval to which they relate.

Other features, objects and advantages of the invention will become more readily apparent from the accompanying drawing, specification and claims.

DESCRIPTION OF THE ILLUSTRATED EMBODIMENT

Figure 1:
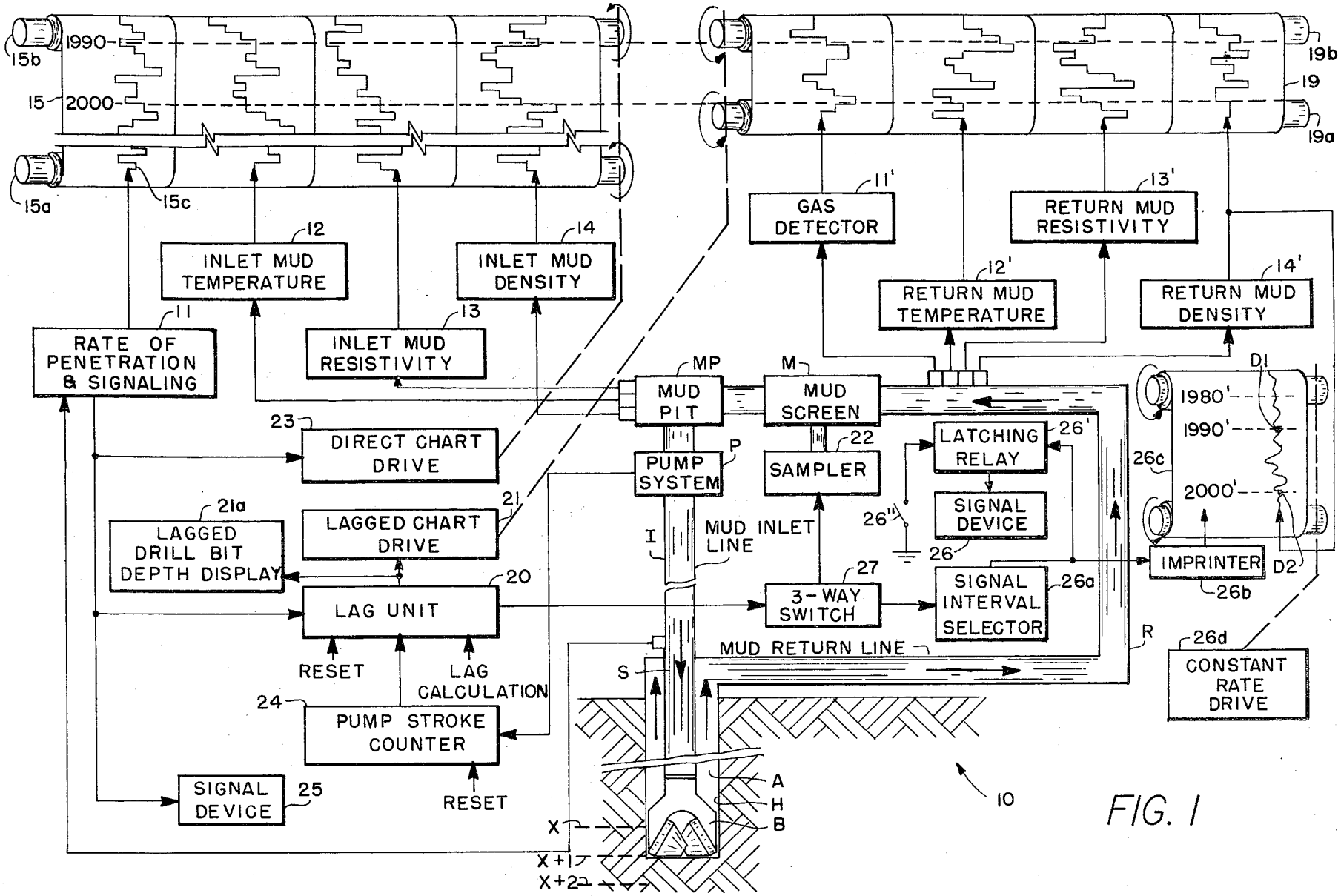
FIG. 1 is a schematic representation of the well monitoring and analyzing system of the present invention.

FIG. 1 of the drawing schematically illustrates the well monitoring and analyzing system of the present invention, indicated generally at 10. The system is employed to monitor the drilling of a well bore H with a conventional drill bit B and drill string S. Drilling fluids, conventionally referred to as mud, are injected downwardly into the well bore H through the drill string S and ejected from the drill bit B into the bore hole H to assist in forming the bore hole, elevating the bit cuttings from the bottom of the bore to the well surface, and providing a hydrostatic back pressure against the formations being penetrated by the bit to prevent the uncontrolled flow of pressurized formation effluents into the well bore. The mud ejected from the bit B is circulated to the well surface through the annular space A formed between the drill string and the surrounding well bore. At the well surface, the mud is channeled into a mud return line R through which it is communicated to a mud screen M. The screen M, which is conventional, functions to remove bit cuttings and other solid particles from the returning mud. The filtered mud leaving the screen is conveyed to a mud pit MP where it is cooled and treated to alter its chemical composition as required. The cooled, treated mud is removed from the pit by a positive displacement pump system P which injects the mud into a mud inlet line I which in turn conveys it through conventional equipment (not illustrated) into the drill string S. As thus far explained, the drilling and mud circulation procedures are conventional.

The system 10 includes various monitoring and measuring means for monitoring the well drilling operation and measuring the parameters of the mud circulating through the system. The well drilling operation is monitored by a rate of penetration measuring means 11 which measures the rate at which the drill bit B and attached drill string S penetrate the formation being drilled. A measuring device 12 determines the temperature of the inlet mud into the drill string, the measuring device 13 measures the resistivity of the inlet mud and a measuring means 14 determines the density of the inlet mud. The devices 11–14, which are conventional, provide an output signal which may be employed to drive a recording pen to graphically record the output data on a strip chart 15. The strip chart 15, which is also conventional, is mechanically driven to advance a strip of paper or other recording medium from a supply roller 15*a* to a takeup roller 15*b*. In conventional fashion, the location of the recording pen at the time of roller advance determines the location of graphical indicia 15*c* on the recording medium. It should be noted that while the mud parameters and drilling rate are measured by the instruments 11–14 at the well surface, the information obtained is representative of that for the mud ejected from the drill bit. While changes in some parameters, such as temperature, may occur in the mud between the time it is measured at the well surface and the time it is ejected from the drill bit, the initially measured values provide a basis for comparison with the output values and are sufficiently accurate for the purpose of permitting immediate visual inspections and evaluations to be made.

Conventional measuring means 12′, 13′ and 14′ are provided for measuring the temperature resistivity and density, respectively, of the returning mud. A gas detector 11′ measures the quantity and type of gas included in the returning mud. The devices 11′–14′, like the input devices 11–14, provide output information which is graphically recorded on a second conventional strip chart 19. In the schematic illustration of FIG. 1, the chart 19 is advanced by mechanically rotating a storage roller 19*a* and a takeup roller 19*b* in the direction indicated by the arrows. While only a few measuring devices have been specifically illustrated in the drawing, it will be appreciated that drilling operations such as drill bit weight, bit revolution rate and any number of parameters of the drilling mud may be measured and that the system may be expanded to accomodate the additional measuring equipment. Suitable measuring devices for the devices 11–14 and 11′–14′ may be obtained from customary supply sources. For example, Geoservices of LeBlanc Mesnil, France manufactures a "Speedograph" which may be employed for the device 11. The Samega Company of Paris, France, also manufactures many automatic devices which may be employed to monitor various drilling operations and measure a large range of mud parameters.

The system of the present invention automatically linearly aligns the graphical data appearing on the charts 15 and 19 so that the data on the chart 15, representing a sample of the mud injected into the bore at the bit B, may be compared correlatively with the data obtained from the same sample of mud when it returns to the well surface. By this means, changes occurring in the mud between the time it is emitted from the bit B and the time it is measured at the well surface may be readily discerned.

Automatic alignment of the input and output data from the same mud sample, as well as the automatic removal of samples from the returning mud, are controlled by the operation of a lag unit 20. Output signals from the lag unit are employed to control operation of a lagged drill bit display 21*a*, a lagged chart drive means 21 and an automatic sampler 22. The display 21*a* provides a visible indication of the drill bit depth at which the returning mud at the well surface was ejected into the well bore. The lagged chart drive means 21 may be any conventional chart drive mechanism which can mechanically advance the chart 19 when an appropriate input signal is received from the lag unit. A direct chart drive 23 functions in the same manner as the drive 21, upon receiving an appropriate input signal from the device 11, to rotate the storage roller 15*a* and takeup roller 15*b* in the direction indicated by the arrows.

The chart 15 advances one increment for each unit of drilling advance of the drill bit B. The two charts 15 and 19 are driven differently to the extent that the chart 15 advances immediately upon receiving an indication from the rate of penetration measuring means 11 that the drill string has advanced 1 foot, or other desired incremental value, into the well bore while the chart 19 advances one increment only when signalled to do so by the lag unit 20.

The lag unit 20 causes the chart 19 to be driven in such a way as to graphically align recorded data on the chart from a sample of mud in the output line with the recorded data on the chart 15, representing the same sample of mud at the time it was emitted from the drill bit B. To this end, the lag unit 20 is provided with input information from the rate of penetration device 11 and from a pump stroke counter 24. While only a single counter 24 has been illustrated, it will be appreciated that any number of counters could be employed depending on the number of pumps in the system P. Inputs for the calculated lag and to effect reset of the unit 20 are also provided. The device 24 counts the total number of pump strokes produced in the pump system P occurring after a designated start time or start count and provides this information to the lag unit.

In operation, each time the drill bit drills into the formation a predetermined amount, for example 1 foot, as indicated to the lag unit by the rate of penetration device 11, the number of elapsed pump strokes from the start or start count in the pump stroke counter 24 is recorded in an internal memory within the lag unit 20. When a selected total of pump strokes, equal to the calculated lag plus the number of elapsed strokes occurring during the incremental advance has been counted, the lag unit produces a first output signal. Thereafter, the lag unit produces an output signal each time the number of pump strokes exceeds the lag number by the amounts recorded for each predetermined unit of bit advance. For example, assuming a lag number of 6,000, a unit advance of 1 foot and further assuming that 60 pump strokes occurred during the first 1 foot of bit advance, 90 strokes occurred during the next 1 foot advance and 10 strokes occurred during the next 1 foot advance, the lag unit would produce its first output signal when a total of 6060 pump strokes occurred and thereafter would produce output signals when the totals reach 6150 strokes and 6160 strokes.

The operation of the system may be most simply described by a specific example. Assume that the lag or number of pump strokes required to pump a sample of drill fluid and/or bit cuttings from the subsurface location X to the well surface is calculated to be 7,860 pump strokes. An operator sets this figure into the lag calculation input for the lag unit 20. The drilling operation then moves the bit from the point X to the point X+1 which is 1 foot deeper into the formation. During the drilling interval between the bit position X and the position X+1, the pump P produces a total of 80 pump strokes which were counted by the counter 24. When the point X+1 is reached by the bit, the rate of penetration device 11 provides an output signal which forms an input to the lag unit 20 to indicate that the bit has moved an integral drilling unit (1 foot) and causes the lag unit 20 to record the accumulated pump stroke count of 80. The output of device 11 also signals the drive 23 causing it to advance the chart 15 by a unit of chart advance which graphically represents one foot of well bore. Simultaneously, the output signal from the device 11 causes an audio, visual or other signal output to be produced by the signal device 25. By this means, an operator who is not actually visibly monitoring the charts is provided with information indicating that the drill bit has advanced a full unitary drilling increment. While drilling from the point X+1 to the next lower unitary incremental point X+2, the pump provides an additional 130 pump strokes making the accumulated count 210. When the bit reaches X+2, the device 11 provides a second output signal and the accumulated count on the pump stroke counter, a total of 210 from the beginning of the count, is recorded as the second entry in the memory of the lag unit. The chart 15 is simultaneously advanced an amount representing 1 foot. This procedure is repeated each time the drill bit advances an additional 1 foot whereby the accumulated pump stroke count at each foot of drilling increment is recorded as a new entry in the memory of the lag unit and the chart 15 is incrementally advanced in step-wise fashion.

When the total count in the pump stroke counter 24 reaches the preset number of 7,860 pump strokes, the counter 24 will reset to 0 and automatically begin a new count. When the new count reaches 80, the lag unit recognizes this as the first entry for the first drilling increment and produces an output which is conveyed to the chart drive 21 which in turn advances the chart 19 by one chart advance increment representing 1 foot. Simultaneously, the lag unit erases the entry for the number 80 from its memory. The counter 24 continues to count pump strokes and when the total new count reaches 210 the lag unit provides an output which again causes the lag chart drive 21 to advance the chart 19 by another incremental unit of chart movement. This procedure continues until the total new pump count in the counter 24 is equal to the lag count of 7,860 pump strokes. The number of incremental advances of the charts 15 and 19 which may occur for any given setting of the lag calculation depends upon the rate of bit penetration. The higher the rate of bit penetration, the greater the amount of chart advance possible for any given lag figure.

Each advance of the chart 19 occurs exactly 7,860 pump strokes after an impulse showing a foot advance is loaded into the lag unit. By this means, an operator who removes samples from the return mud line during the time the new pump stroke count was between 80 and 210, for example, will be taking samples from the fluid ejected from the bit while the bit was moving between points X and X+1. The cuttings removed from this fluid can be traced back to the formation between the same two points. The actual depth from which the cuttings or fluid sample originated can be determined from the foot markings on the charts or by reference to the display 21*a*.

The chart 19 does not begin to advance until the lag count has expired. In the interim period, however, the chart 15 advances one increment with each foot of advance of the bit. Initial alignment of the input data and the output data from the same sample may be accomplished, for example, by delaying the display of the data on chart 15 by an appropriate amount as schematically indicated in the drawing. Thus, the data produced on the chart 15 is produced at the time the mud is returned to the well surface. Since it is desired to align the input and output data representing the same sample along a common axis, the display of the input data must be delayed until the output data is obtained. To this end, the output data chart portion showing data taken from the mud ejected from the bit at the point X in the well is aligned with that portion of the input data chart showing data recorded with the drill bit at point X.

A signal device 26 provides a suitable signal indicating that the returning mud and/or drill bit cuttings are from the formation area between the selected incremental points. A three-way switch 27 may be appropriately set either to cause an automatic sample of mud and/or bit cuttings to be removed from the returning mud when the lag unit provides an appropriate output signal, or, to provide an output signal on the device 26 or, in the third position, to take a sample and also provide an output signal. In a preferred form of operation, the output signal device 26 would provide an audio alarm, holding through an appropriate latching relay 26', until manually deactivated through a switch 26'' by the rig personnel. Such operation would ensure that the alarm is heeded and the sample is taken. A signal interval selector 26*a* is provided to permit selection of the number of incremental advances required to form an output signal in the device 26 to initiate manual sampling. The selector 26*a* is a simple electronic counter which accumulates input signals until a predetermined input count is reached, forms an output signal, resets to zero and begins a new count. This permits an operator to remove samples representative of selected increments, for example, every ten feet or every twenty feet of drill bit advance.

The output from the selector 26*a* is used to control operation of an imprinter 26*b* which in turn forms depth markings on a strip chart 26*c*. The chart 26*c* is driven at a constant rate by a drive 26*d*. All of the components 26*b*, 26*c* and 26*d* are conventional. The imprinter 26*b* may be adjusted to provide a beginning count after which it provides an appropriate marking on the chart 26*c* each time it receives a signal from the selector 26*a*. The markings on the chart depict bit depth and the incremental advance between successive markings is selected by appropriately setting the selector 26*a*.

Return mud density is graphically recorded on the chart 26*c* just as it is on the chart 19. The difference in the display is caused by the fact that the chart 19 advances in discrete steps at a rate dependent upon the bit penetration rate whereas the chart 26*c* is advanced at a constant rate unrelated to the rate of bit penetration.

While numerals have been shown, it will be appreciated that any suitable indicia representative of the bit depth may be formed on the recording medium. By way of example, the chart 26*c* shows return mud density D1 for a sample of mud emitted from the bit when the bit was at 1990 feet and density D2 for a sample ejected with the bit at 2000 feet. While only mud density is shown on the chart 26*c*, it will be appreciated that any number of parameters may be simultaneously formed on the chart.

From the foregoing it will be appreciated that the system of the present invention automatically provides graphically recorded data showing the condition and content of a given sample of the drilling fluid when it is injected into a well and when it is returned to the well surface and simultaneously provides a means for aligning the input and output data from the sample along a common axis so that immediate comparisons may be made. Automatic signalling and sampling means are provided so that appropriate samples are removed from a desired portion of the returning drill fluid which in turn was obtained from a selected subsurface position within the well bore.

A lag unit capable of providing the function described for the lag unit 20 is produced and marketed by the Dynapar Corporation of Gurnee, Illinois under the trademark GEO-LAG. The GEO-LAG unit employs a three or four decade numerical thumb wheel switch for setting the lag calculation figure into the unit to the nearest 10 pump strokes. A display of the preset lag number is provided to permit identification of the memory position being interrogated and a reset is provided for clearing the memory and for starting the system over at zero pump strokes. Input indicators light up when a pump stroke or drill advance input is received in the GEO-LAG unit and an output indicator provides a light when an output signal is formed by the unit. While the Dynapar GEO-LAG unit is satisfactory for purposes of the present invention, it will be understood that any means capable of providing the indicated functions and the sequential operations of the lag unit 20 may be employed in the system of the present invention.

The foregoing disclosure and description of the invention is illustrative and explanatory thereof and various changes in the size, shape and materials as well as in the details of the illustrated construction may be made within the scope of the appended claims without departing from the spirit of the invention. Thus, while the present invention has been described with specific reference to graphical recording means, it will be appreciated that any recording medium, including magnetic tape or other means, may be employed for recording the information and that such recorded information may be employed to form a visual display from which the desired comparisons and analyses may be made. Moreover, while the system of this invention has been described for on-site use, the data may also be transmitted in digital or other form to a remote location where the graphical displays may be formed.

As used herein, the term "graphical" is intended to indicate visible indicia and is not limited to the chart markings specifically described. If desired, the visible indicia or graphical display may comprise printed number values rather than lines on a chart whereby the numbers representing the various input and output parameters for a given sample of mud or cuttings are related by being displayed in a column, row or other visibly discernable configuration.

I claim:

1. A system for monitoring a well being drilled with a drill string and drill bit comprising:

a. input measuring and recording means for measuring and recording the input values of one or more parameters of drilling fluid and/or matter included in said drilling fluid before such fluid is injected into the well bore through said drill string and drill bit;

b. output measuring and recording means for measuring and recording the output values of one or more parameters of said drilling fluid and/or matter included in said drilling fluid after said fluid is ejected from the drill bit into the well bore;

c. display means for forming a visible display representative of said input and output parameter values;

d. lag means responsive to the drill bit location and to the volume of fluid injected into the well for automatically relating the display of the input and output parameter values for a selected sample of said drilling fluid and/or matter included in said drilling fluid;

e. a first strip chart included in said input measuring and recording means which is advanced by one incremental chart unit, representative of a unit of drill bit advance, each time the drill bit drills through a selected interval of the formation; and f. a second strip chart included in said output measuring and control means which is advanced by one incremental chart unit under the control of said lag means after said selected sample, comprising all of the drilling fluid injected into the well bore during the drilling of said selected formation interval, has been pumped past a selected location in said output measuring and recording means.

2. A system as defined in claim 1 further including means for positioning said first and second strip charts to form a visual display in which the graphically recorded data representing the input and output parameter values for said selected sample is automatically aligned along common linear axes.

3. A system as defined in claim 2 further including sampling means for automatically sampling material included in said selected sample of said drilling fluid.

4. A system as defined in claim 2 further including signalling alarm means for automatically signalling the presence of said selected sample at a predetermined location in said output measuring and recording means.

5. A system for monitoring a well being drilled with a drill string and drill bit comprising:

a. input measuring and recording means for measuring and recording the input values of one or more parameters of drilling fluid and/or matter included in said drilling fluid before such fluid is injected into the well bore through said drill string and drill bit;

b. output measuring and recording means for measuring and recording the output values of one or more parameters of said drilling fluid and/or matter included in said drilling fluid after said fluid is ejected from the drill bit into the well bore;

c. display means for forming a visible display representative of said input and output parameter values;

d. lag means responsive to the drill bit location and to the volume of fluid injected into the well for automatically relating the display of the input and output parameter values for a selected sample of said drilling fluid and/or matter included in said drilling fluid; and e. sampling means for automatically sampling material included in said selected sample of said drilling fluid.

6. A system as defined in claim 5 further including signalling alarm means for automatically signalling the presence of said selected sample at a predetermined location in said output measuring and recording means.

7. A system for monitoring a well being drilled with a drill string and drill bit comprising:

a. input measuring and recording means for measuring and recording the input values of one or more parameters of drilling fluid and/or matter included in said drilling fluid before such fluid is injected into the well bore through said drill string and drill bit;

b. output measuring and recording means for measuring and recording the output values of one or more parameters of said drilling fluid and/or matter included in said drilling fluid after said fluid is ejected from the drill bit into the well bore;

c. display means for forming a visible display representative of said input and output parameter values;

d. lag means responsive to the drill bit location and to the volume of fluid injected into the well for automatically relating the display of the input and output parameter values for a selected sample of said drilling fluid and/or matter included in said drilling fluid; and e. signalling alarm means for automatically signalling the presence of said selected sample at a predetermined location in said output measuring and recording means.

8. A system for monitoring a well being drilled with a drill string and drill bit comprising:

a. input measuring and recording means for measuring and recording the input values of one or more parameters of drilling fluid and/or matter included in said drilling fluid before such fluid is injected into the well bore through said drill string and drill bit;

b. output measuring and recording means for measuring and recording the output values of one or more parameters of said drilling fluid and/or matter included in said drilling fluid after said fluid is ejected from the drill bit into the well bore;

c. display means for forming a visible display representative of said input and output parameter values;

d. lag means responsive to the drill bit location and to the volume of fluid injected into the well for automatically relating the display of the input and output parameter values for a selected sample of said drilling fluid and/or matter included in said drilling fluid;

e. second display means connected with said output measuring and recording means for forming a visual display representative of said output parameter values; and f. lag responsive means connected with said second display means for automatically relating the visual display on said second display means representative of parameter values for a particular sample with the bore depth at which such sample was ejected from said drill string into the well bore.

9. A system as defined in claim 8 wherein said second display means includes a strip chart recorder means which is driven at a constant rate independent of the drill bit penetration rate.

10. A system as defined in claim 9 wherein said lag responsive means includes imprinting means for automatically imprinting indicia representative of a given bit depth on the strip chart in said recorder means correlative with the indicia on said chart representative of the output parameter values obtained from fluid samples ejected from the drill string at such bit depth.

11. A system as defined in claim 10 further including means for varying the amount of drill bit advance required to initiate operation of said imprinter.

12. A system for monitoring a well bore being drilled with a drill string, drill bit and drilling fluid comprising:

a. output measuring and recording means for measuring and recording the output values of one or more parameters of said drilling fluid and/or matter included in a given sample of said drilling fluid after said fluid sample is ejected from said drill string and bit into the well bore and circulated to the well surface;

b. display means for forming a visual display representative of said output parameter values;

c. lag means responsive to the drill bit depth within the well bore and to the volume of fluid injected into the well bore for automatically relating the visual display of parameter values for a particular sample with the bore depth at which such sample was ejected from said drill string into the well bore; and d. a strip chart recorder means included in said display means which is driven at a constant rate independent of the drill bit penetration rate.

13. A system as defined in claim 12 further including imprinting means controlled by said lag means for automatically imprinting indicia representative of a given bit depth on the strip chart in said recorder means correlative with the indicia on said chart representative of the output parameter values obtained from fluid samples ejected from the drill string at such bit depth.

14. A system as defined in claim 13 further including means for varying the amount of drill bit advance required to initiate operation of said imprinter.

15. A system for automatically measuring, graphically recording and correlating input and output data where said input data is representative of the parameter values of drilling fluid before it is injected into a well bore from a drill string and attached drill bit and said output data is representative of the parameter values of the same drilling fluid after it is ejected from the drill bit and circulated to the well surface comprising:

a. input measuring means for measuring the parameter values of the drilling fluid before it is injected into said well bore;

b. input strip chart means connected with said input measuring means for graphically recording the parameter values measured by said input measuring means;

c. well depth measuring means for automatically providing an output signal each time the drill bit has drilled a predetermined length of bore hole;

d. direct chart drive means controlled by the output signals of said well depth measuring means for selectively advancing said input chart means by a representative amount each time said predetermined length of bore hole has been drilled;

e. output measuring means for measuring the parameter values of the drilling fluid when it is circulated to the well surface after being ejected from the drill bit into said well bore;

f. output strip chart means connected with said output measuring means for graphically recording the parameter values measured by said output measuring means;

g. lag means responsive to the volume of fluid injected into said well bore and to the output signals of said well depth measuring means for forming an output signal, after the lag volume has been injected, each time an additional volume of fluid equal to that injected between each sequentially occurring output signal from said depth measuring means is injected into said well bore; and h. lagged chart drive means controlled by the output signals of said lag means for selectively advancing said output chart means by said representative amount each time one of said lag means output signals is produced.

16. A system as defined in claim 15 further including positioning means for relatively positioning said input and said output strip chart means to form a visual display in which the graphically recorded data representing the input and output data from the same sample of said drilling fluid is automatically aligned along common linear axes.

17. A system as defined in claim 16 further including sampling means for automatically removing matter from a selected portion of said drilling fluid after it is returned to the well surface.

18. A system as defined in claim 17 further including signalling means for automatically signalling the arrival of a selected portion of returning drilling fluid at the well surface.

19. A system as defined in claim 16 further including signalling means for automatically signalling the arrival of a selected portion of returning drilling fluid at the well surface.

20. A system for monitoring a well drilling operation in which a well bore is being drilled through a subsurface formation with a drill string, drill bit and drilling fluid comprising:

a. well depth measuring means for automatically providing an output signal each time the drill bit has drilled a predetermined length of bore hole through the formation;

b. lag means responsive to the volume of drilling fluid injected into said well bore and to the output signals of said well depth measuring means for forming an output signal, after the lag volume of drilling fluid has been injected, each time an additional volume of drilling fluid equal to that injected during the interval between each sequentially occurring output signal from said depth measuring means is injected into said well bore; and c. signalling means responsive to the output signals from said lag means for automatically signalling the arrival at the well surface of drilling fluids and/or cuttings emitted from the drill bit or cut away from the formation at a given subsurface well location whereby samples of fluids and/or cuttings taken at the surface at times indicated by said signalling means may be correlated with such given subsurface well location.

21. A system as defined in claim 20 wherein said signalling means comprises an audio alarm.

22. A system as defined in claim 21 further including:

a. latching means for maintaining said audio alarm once it is initiated; and b. manual reset means for deactivating said audio alarm.

23. A system as defined in claim 20 further including depth identifying means identifying the bit depth from which fluids and/or cuttings circulated to the well surface were ejected from the bit and/or cut away from the formation, respectively.

24. A system as defined in claim 23 wherein said signalling means comprises an audio alarm.

a. latching means for maintaining said audio alarm once it is initiated; and b. manual reset means for deactivating said audio alarm.

25. A system as defined in claim 24 further including:

a. latching means for maintaining said audio alarm once it is initiated; and b. manual reset means for deactivating said audio alarm.

* * * * *

UNITED STATES PATENT OFFICE
CERTIFICATE OF CORRECTION

Patent No. 3,982,432 Dated September 28, 1976

Inventor(s) William D. Hammond

It is certified that error appears in the above-identified patent and that said Letters Patent are hereby corrected as shown below:

Claim 24, column 14, please delete everything on lines 5, 6, 7, and 8.

Signed and Sealed this

Twenty-second Day of February 1977

[SEAL]

*Attest:*

RUTH C. MASON
*Attesting Officer*

C. MARSHALL DANN
*Commissioner of Patents and Trademarks*